United States Patent [19]

Wood et al.

[11] Patent Number: 4,507,587

[45] Date of Patent: Mar. 26, 1985

[54] MICROWAVE GENERATED ELECTRODELESS LAMP FOR PRODUCING BRIGHT OUTPUT

[75] Inventors: Charles H. Wood, Bethesda; Michael G. Ury, Rockville, both of Md.

[73] Assignee: Fusion Systems Corporation, Rockville, Md.

[21] Appl. No.: 381,482

[22] Filed: May 24, 1982

[51] Int. Cl.[3] ..... H01J 7/46; H01J 19/80

[52] U.S. Cl. ..... 315/39; 315/248; 315/344

[58] Field of Search ..... 315/39, 248, 399, 344

[56] References Cited

U.S. PATENT DOCUMENTS

| | | | |
|---|---|---|---|
| 3,374,393 | 3/1968 | Bramley | 315/39 |
| 3,609,448 | 9/1971 | Williams | 315/39 |
| 3,641,389 | 2/1972 | Leidigh | 315/39 |
| 3,787,705 | 1/1974 | Bolin et al. | 315/39 |
| 3,826,950 | 7/1974 | Hruda, et al. | 315/39 |
| 3,872,349 | 3/1975 | Spero et al. | 315/39 |
| 3,911,318 | 10/1975 | Spero et al. | 315/39 |
| 3,943,402 | 3/1976 | Haugsjaa et al. | 315/39 |
| 4,001,632 | 1/1977 | Haugsjaa et al. | 315/39 |
| 4,042,850 | 8/1977 | Ury et al. | 315/39 |
| 4,359,668 | 11/1982 | Ury | 315/39 |

FOREIGN PATENT DOCUMENTS

| | | | |
|---|---|---|---|
| 54-82876 | 7/1979 | Japan | 315/248 |
| 56-126250 | 10/1981 | Japan | 315/248 |

*Primary Examiner*—Saxfield Chatmon

*Attorney, Agent, or Firm*—Pollock, Vande Sande & Priddy

[57] ABSTRACT

A microwave generated electrodeless light source for producing a bright output comprising a lamp structure including a microwave chamber and a plasma medium-containing lamp envelope having a maximum dimension which is substantially less than a wavelength disposed therein. To provide the desired radiation output the interior of the chamber is coated with a UV-reflective material and the chamber has an opening for allowing UV radiation to exit, which is covered with a metallic mesh. The chamber is arranged to be near-resonant at a single wavelength, and the lamp envelope has a fill including mercury at an operating pressure of 1–2 atmospheres, while a power density of at least 250–300 (watts/cm$^3$) is coupled to the envelope to result in a relatively high deep UV output at a relatively high brightness.

14 Claims, 3 Drawing Figures

FIG.1
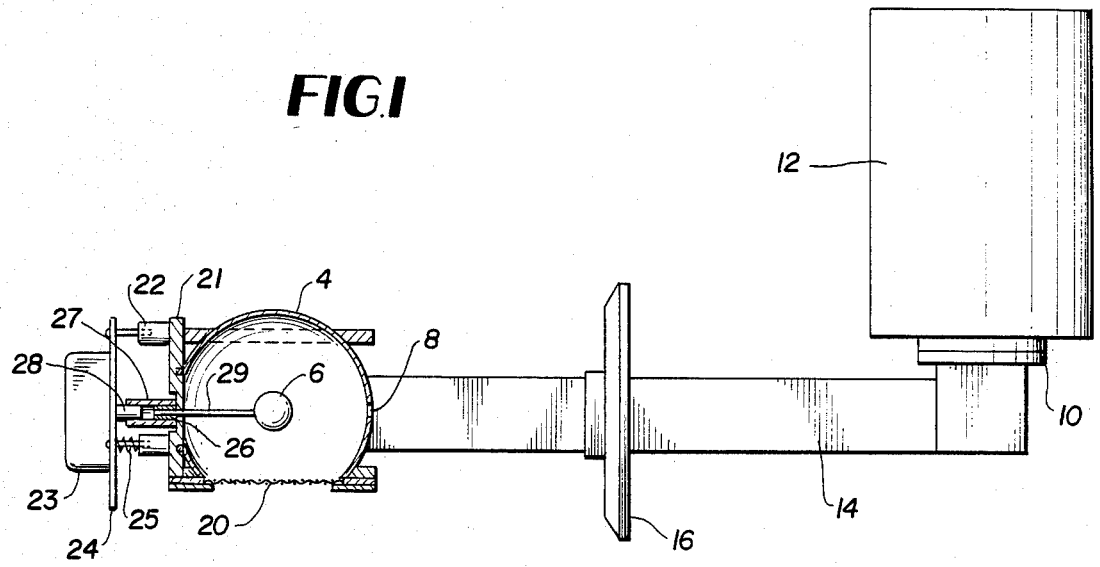
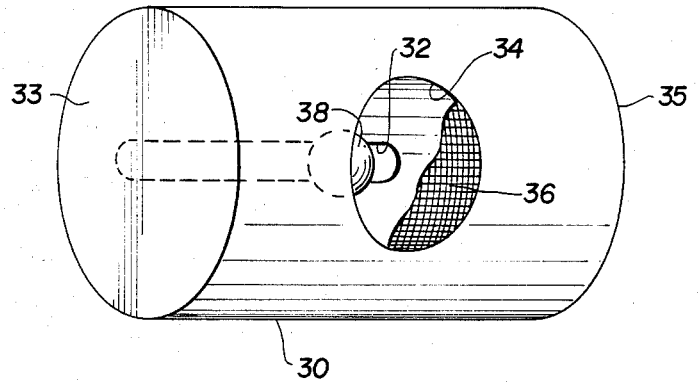
FIG.2
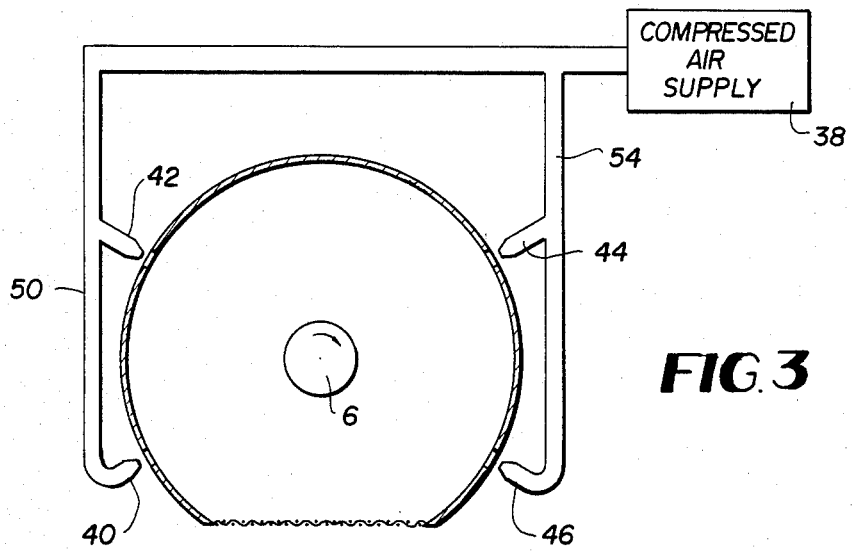
FIG.3

MICROWAVE GENERATED ELECTRODELESS LAMP FOR PRODUCING BRIGHT OUTPUT

The present invention is directed to new microwave generated electrodeless light sources and particularly to such light sources which are useful in the practice of deep UV photolithography.

The exposure step in deep UV photolithography requires the use of a light source which is extremely bright and which has a relatively high output in the deep UV part of the spectrum (190–260 nm). The source which is presently most widely used is the xenon-mercury (Xe-Hg) arc lamp in which radiation is provided by an arc discharge which occurs between two electrodes in the lamp envelope.

The primary problem with the Xe-Hg lamp as well with other arc lamps which have been tried in the practice of deep UV photolithography is that their spectral output in the deep UV region is too low. For example, the Xe-Hg lamp converts less than 2% of the electrical power inputted to it to output radiation in the deep UV.

It is the goal of the present invention to provide microwave generated electrodeless light sources which output radiation having relatively higher spectral components in the deep UV and to provide such radiation at the brightness levels which are required in the practice of deep UV photolithography. While microwave generated light sources are known in the prior art, they typically are of relatively low or moderate brightness, where brightness is defined as $$\frac{\text{radiation flux output}}{\text{surface area}}$$

and are therefore not suitable for application to photolithography or other uses where high brightness is required. Heretofore, there has been no lamp structure known for coupling microwave energy to a small lamp envelope at high power densities to provide a bright source.

It is therefore an object of the invention to provide microwave generated electrodeless lamp structures which are suitable for use in deep UV photolithography.

It is a further object of the invention to provide electrodeless lamp structures which provide a relatively high spectral output in deep UV region at relatively high brightness levels.

It is still a further object of the invention to provide a light source in which coupling to the plasma forming medium is relatively efficient, and in which the ratio of reflected power to absorbed power is relatively small.

In accordance with the invention, the above objects are accomplished by providing a microwave generated electrodeless lamp structure comprised of a microwave chamber and a plasma forming medium containing lamp envelope having a maximum dimension which is substantially less than a wavelength of the microwave energy utilized, disposed therein. The chamber has a slot for coupling microwave energy to the envelope. To provide the desired radiation output the interior of the chamber is coated with a UV-reflective material and the chamber has an opening for allowing UV radiation to exit, which is covered with a metallic mesh which is substantially transparent to UV but substantially opaque to microwaves.

To provide the desired coupling to the small envelope the chamber is arranged to be near-resonant at a single wavelength of the microwave energy. Additionally, the plasma forming medium in the envelope is mercury which is present at a relatively low pressure in the order of one atmosphere. When energy at a power density of at least 250–300 (watts/cm$^3$) is coupled to the envelope, a small skin depth results so that most of the discharge occurs towards the outer radii of the envelope, resulting in relatively high deep UV output at a relatively high brightness level.

The resulting electrodeless light source is suitable for use in deep UV photolithography and is superior to existing sources for this application. Thus in the preferred embodiment, the source of the invention converts approximately 8% of the electrical energy inputted to it to output in the deep UV part of the spectrum at required brightness levels as opposed to only 2% for the most widely used prior art compact arc lamp source.

The invention will be better appreciated by referring to the accompanying drawings in which:

FIG. 1 is an illustration of a first embodiment of the invention.

FIG. 2 is an illustration of a second embodiment of the invention.

FIG. 3 is an illustration of a cooling system which is used with the apparatus of the invention.

Referring to FIG. 1, microwave generated electrodeless lamp 2 is shown and is seen to be comprised of chamber 4 and lamp envelope 6 which is disposed in the chamber. Lamp envelope 6 has a maximum dimension which is substantially smaller than a wavelength of the microwave energy which is utilized and chamber 4 has a slot 8 for efficiently coupling microwave energy to the envelope. The microwave energy is supplied by magnetron 10 which is activated by a power supply 12, and the microwave energy generated by the magnetron is fed through rectangular wavelength section 14, tunable by tuning stub 16, to the slot 8 in the microwave chamber.

It is desired for the lamp to have a UV output of a shape which is not dictated by microwave design considerations. In this regard, chamber 4 is arranged to have a shape which is desirable from an optical applications point of view. The interior of the chamber is coated with a UV reflective material and the chamber has an opening 18 for allowing ultraviolet radiation which is emitted by the lamp envelope to pass out of the chamber. The opening is covered with a metallic mesh 20 which is substantially transparent to the ultraviolet radiation, but substantially opaque to the microwave energy within the chamber.

In accordance with a further feature of the invention, in order to efficiently couple the microwave energy to the lamp envelope, the chamber itself is arranged to be near-resonant, but not resonant as calculated for an ideal chamber without a lamp present. It has been found that a condition of near resonance results in maximum coupling the small envelope 6, and consequently maximum light output therefrom. Further, to maximize coupling, the chamber is near-resonant at a single wavelength rather than a multiple of wavelengths, which insures that the microwave energy is efficiently absorbed.

In the preferred embodiment of the invention depicted in FIG. 1, the envelope 6 is spherical in shape, as is microwave chamber 4, and the envelope is positioned in the center of the chamber. The relative positioning of the slot 8 and opening 18 shown in FIG. 1 provide a relatively uniform UV output through mesh 20. This is significant because UV photolithography, as well as other applications, requires uniform irradiation.

In order to provide the brightness levels required for deep UV photolithography, it is necessary to couple substantially higher than conventional power density levels to envelope 6. At the same time, it is desired to provide a relatively high output in the deep UV portion of the spectrum, and it has been found that to accomplish this it is desirable for the radiation be emitted at the outer radii of envelope 6 rather than towards the interior thereof. The reason for this is that radiation emitted towards the interior of the envelope has a tendency to be absorbed by the plasma before reaching the envelope wall, and additionally, it is believed that the deep UV wavelengths are preferentially absorbed.

In order to cause UV radiation emission at the outer radii, it is necessary to cause the skin depth $\epsilon$ of the plasma to be relatively thin. However, as the skin depth becomes thinner, it becomes more and more difficult to couple energy into the plasma. It has been found that by arranging the pressure of the plasma forming medium, which in the case of the preferred embodiment, is mercury, to be relatively low, in an operating range of from 1 to 2 atmospheres, and by coupling microwave energy in a power density of greater than 300 (watts/cm$^3$) enhanced deep UV spectral output at the required brightness level is obtained.

In the preferred embodiment of the invention illustrated in FIG. 1, metallic chamber 2 is 3.9" diameter sphere having a 2.8" circular opening 18 which is covered by mesh 20. Mesh 20 is a grid of 0.0017" diameter wires having of spacing of 0.033" between wire centers. Spherical lamp envelope 4 is 0.75" in interior diameter and is filled with Hg, a noble gas such as argon, and HgCl. The mercury fill is at a relatively low pressure, and during operation the Hg is about 1–2 atmospheres while the argon is about 100–200 torr. In order to obtain the appropriate operating pressure of Hg, a volume of approximately $2\times10^{-6}$ ml of liquid mercury is inserted to the bulb during manufacture.

Magnetron 10 provides about 1500 watts of microwave power at a frequency of 2450 Mhz. The major part of this power is coupled to the plasma, resulting in a power density of approximately 500 (watts/c.c.). The resulting light source has a conversion efficiency in the deep UV part of the spectrum of about 8%, and is a bright source which radiates at about 190 (watts/c.c.). Additionally, the source is very efficient, as most of the power entering the coupling slot is absorbed, with only a small amount being reflected, which results in a suitably long lifetime for the magnetron.

While the preferred embodiment has been illustrated in connection with a spherical envelope and spherical chamber, it is to be understood that other envelope and chamber shapes are possible without departing from the spirit of the invention. By way of non-limitative example, FIG. 2 depicts an embodiment utilizing a spherical lamp envelope in a cylindrical chamber. Referring to the Figure, chamber 30 has microwave coupling slot 32 therein, and mesh covered opening 34 for allowing ultraviolet radiation to exit therefrom diametrically opposed on the cylindrical surface from slot 32. Lamp envelope 38 is positioned at the geometrical center of the cylinder, which is dimensioned to be at near-resonance for a single wavelength. A variety of other envelope shapes are possible, and examples of other chamber shapes are ellipsoids, hyperboloids, parabaloids and re-entrant spheres. Additionally, the microwave chamber may be provided with more than one coupling slot.

The high power density at which the lamp envelope is operated causes the surface of the quartz envelope to become extremely hot. In order to suitably cool the envelope, a cooling system has been developed wherein the envelope is rotated while a plurality of jets of cooling gas are directed at it.

Referring to FIG. 1, it will be seen that lamp envelope 6 has a stem 29 which is rotated by motor 23. The motor shaft is connected to stem 29 via a mechanical coupler so that the stem is effectively an extension of the motor shaft. While a variety of mechanical configurations known to those skilled in the art may be used to secure the motor and seal the opening through which the shaft passes to the leakage of microwaves, a system using flange 21, motor mounting flange 24 and spacing posts 22 is illustrated. FIG. 3 shows the system for directing cooling gas at the envelope as it rotates, and more specifically depicts nozzles 40, 42, 44, and 46, which are fed by compressed air supply 38. The nozzles are directed approximately at the center of the envelope and combined with the rotation provide a substantial cooling effect.

There thus have been disclosed various structures for microwave generated electrodeless lamps which provide efficient bright light sources which are rich in deep ultraviolet radiation. While the invention has been disclosed in connection with use for deep UV photolithography, it should appreciated that it may find use wherever a bright source is required, since the fill may be varied to de-emphasize the deep UV and emphasize the ultraviolet or visible.

Accordingly, it should be understood that variations calling within the scope of the invention may occur to those skilled in the art, and the invention is limited only by the claims appended hereto, and equivalents.

We claim:

1. A microwave generated electrodeless lamp which radiates with substantial brightness and uniformity, comprising:

microwave energy generating means for generating microwave energy of a characteristic frequency, a microwave chamber having a slot for admitting microwave engine of said characteristic frequency to the chamber, waveguide means for coupling said microwave energy of said characteristic frequency from said microwave energy generating means to said microwave chamber, an envelope in said microwave chamber which contains a plasma forming medium, said envelope having a maximum dimension which is substantially smaller than a wavelength of said microwave energy of characteristic frequency, said chamber having an opening for allowing radiation which emitted by said envelope to exit, and, said opening being covered by a mesh which is substantially transparent to ultraviolet radiation but substantially opaque to said microwave energy.

2. The lamp of claim 1 wherein said microwave chamber without said envelope in it is a near-resonant cavity.

3. The lamp of claim 2 wherein said microwave chamber is near-resonant at a single wavelength of said microwave energy.

4. The lamp of claim 3, further including, means for generating microwave energy at said particular frequency, and means for coupling said generated microwave energy to said slot.

5. The lamp of claim 4 wherein said plasma forming medium containing envelope is spherical.

6. The lamp of claim 1 wherein said microwave chamber is substantially spherical in shape.

7. The lamp of claim 5 wherein said microwave chamber is substantially spherical in shape.

8. The lamp of claim 7 wherein the interior of said microwave chamber is coated with ultraviolet radiation reflecting material.

9. The lamp of claim 8 wherein said envelope is located at the center of said spherical chamber.

10. The lamp of claim 9 wherein said slot and said opening to allow radiation to exit are displaced from each other by 90° around said spherical chamber.

11. The lamp of claim 4 wherein said chamber is cylindrical in shape, the radius of said cylinder being a near resonant dimension.

12. The lamp of claim 11 wherein the envelope is located at the geometric center of said cylindrical chamber.

13. The lamp of claim 12 wherein said slot and said opening for allowing radiation to exit are located diametrically opposite each other on the curved wall of the cylindrical chamber, said envelope being located therebetween.

14. The lamp of claim 1 which is relatively rich in deep UV output and wherein said envelope contains mercury at a pressure of approximately 1 to 2 atm. during operation, and microwave energy at a power density exceeding 250 (watts/cm$^3$) is coupled to said envelope, whereby a skin depth less than half the radius of said envelope results and deep UV radiation is emitted at outer radii of the envelope.

* * * * *